US006883345B2

(12) United States Patent
Lee

(10) Patent No.: US 6,883,345 B2
(45) **Date of Patent: *Apr. 26, 2005**

(54) MULTI-TYPE AIR CONDITIONER AND METHOD FOR OPERATING THE SAME

(75) Inventor: Chang Seon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/447,960

(22) Filed: May 30, 2003

(65) Prior Publication Data

US 2003/0230105 A1 Dec. 18, 2003

(30) Foreign Application Priority Data

Jun. 12, 2002 (KR) ..... 10-2002-0032900

(51) Int. Cl.[7] ..... F25B 13/00; F25B 41/06
(52) U.S. Cl. ..... 62/324.6; 62/511; 62/528
(58) Field of Search ..... 62/324.6, 510, 62/324.1, 324.4, 511, 528, 325, 160

(56) References Cited

U.S. PATENT DOCUMENTS

| | | | | |
|---|---|---|---|---|
| RE30,242 E | * | 4/1980 | del Toro et al. | 62/324.6 |
| 4,912,937 A | * | 4/1990 | Nakamura et al. | 62/160 |
| 5,142,879 A | * | 9/1992 | Nakamura et al. | 62/160 |
| 5,245,837 A | | 9/1993 | Kitamoto | |

FOREIGN PATENT DOCUMENTS

| | | |
|---|---|---|
| EP | 0453271 | 10/1991 |
| EP | 0496505 | 7/1992 |
| EP | 0509619 | 10/1992 |
| EP | 0514086 | 11/1992 |
| EP | 0575063 | 12/1993 |
| JP | 62252865 | 11/1987 |
| JP | 3-51672 | 3/1991 |
| JP | 5-172430 | 7/1993 |
| JP | 6-137710 | 5/1994 |
| JP | 7-4779 | 1/1995 |
| JP | 2000-346488 | 12/2000 |

OTHER PUBLICATIONS

English Language Abstract of JP 7–4779.
English Language Abstract of JP 5–172430.
English Language Abstract of JP 2000–346488.
English Language Abstract of JP 3–51672.
English Language Abstract of JP 6–137710.

* cited by examiner

*Primary Examiner*—Denise L. Esquivel
*Assistant Examiner*—Filip Zec
(74) *Attorney, Agent, or Firm*—Greenblum & Bernstein, P.L.C.

(57) ABSTRACT

Multi-type air conditioner including an outdoor unit installed outside of a room having a compressor and an outdoor unit mounted therein, a plurality of indoor units each installed in a room having an electronic expansion valve and an indoor heat exchanger, a distributor for separating refrigerant from the outdoor unit at a gas-liquid separator and guiding separated refrigerant to the plurality of indoor units selectively depending on operation conditions, a first connection pipe for guiding the refrigerant from the outdoor unit to the gas-liquid separator in the distributor, a second connection pipe for guiding the refrigerant from the distributor to the outdoor unit, and a switching part in the outdoor unit having a first four way valve provided to a discharge side of the compressor for selective switching of a flow direction of the refrigerant flowing in the outdoor heat exchanger, and a second four way valve provided to be switched in conformity with switching of the first four way valve for maintaining the first connection pipe as a high pressure section high pressure refrigerant flows therein, and the second connection pipe as a low pressure section low pressure refrigerant flows therein, thereby permitting optimal dealing with individual room conditions.

20 Claims, 5 Drawing Sheets

MULTI-TYPE AIR CONDITIONER AND METHOD FOR OPERATING THE SAME

This application claims the benefit of the Korean Application No. P2002-32900 filed on Jun. 12, 2002, which is hereby incorporated by reference.

BACKGROUND OF THE INVENTION

1. Field of the Invention

The present invention relates to air conditioners, and more particularly, to a multi-type air conditioner which carries out cooling and heating at the same time, and a method for operating the same.

2. Background of the Related Art

In general, the air conditioner is an appliance for cooling or heating a room space, such as a residential space, a restaurant, and an office. Recently, there have been ceaseless developments of multi-type air conditioner for more efficient cooling or heating of a room space partitioned into a plurality of rooms.

The multi-type air conditioner is provided with one outdoor unit and multiple indoor units each connected to the one outdoor unit and installed in each room. The multi-type air conditioner operative either cooling or heating mode for air conditioning a room.

However, of the plurality of rooms, even in a case when a certain room requires heating while other rooms require cooling, since the multi-type air conditioner is operating in a cooling mode or heating mode uniformly, the multi-type air conditioner has a limit in dealing with such a requirement.

For an example, there are rooms in a building of which temperature differs from other room depending on locations of the rooms or time in a day. That is, while rooms in a north side part of the building require heating, rooms in a south side part of the building require cooling, to which requirement the multi-type air conditioner fails to deal with. Moreover, in a case the building has a computer room, which requires cooling for coping with heat generation of the computer, not only in summer, but also in winder, the multi-type air conditioner fails to deal with such a requirement.

In order to solve such a problem, it is necessary to air condition the rooms simultaneously and individually during the multi-type air conditioner is in operation. That is, it is required that the indoor unit in a room which requires heating is operated in a heating mode, and, at the same time with this, the indoor unit in a room which requires cooling is operated in a cooling mode. Accordingly, development of a multi-type air conditioner of simultaneous cooling/heating type is required, which can carry out above function, and has an economic installation structure.

SUMMARY OF THE INVENTION

Accordingly, the present invention is directed to a multi-type air conditioner that substantially obviates one or more of the problems due to limitations and disadvantages of the related art.

An object of the present invention is to provide a multi-type air conditioner which can carry out heating and cooling at the same time, and a method for operating the same.

Another object of the present invention is to provide a multi-type air conditioner which can improve an efficiency, simplify a fabrication process, and drop a production cost.

Further object of the present invention is to provide a multi-type air conditioner which can prevent non-uniform refrigerant flow caused by variation of a specific volume.

Still further object of the present invention is to provide a multi-type air conditioner of which indoor unit piping is easy, and can improve an outer appearance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the multi-type air conditioner includes an outdoor unit installed outside of a room having a compressor and an outdoor unit mounted therein, a plurality of indoor units each installed in a room having an electronic expansion valve and an indoor heat exchanger, a distributor for separating refrigerant from the outdoor unit at a gas-liquid separator and guiding separated refrigerant to the plurality of indoor units selectively depending on operation conditions, a first connection pipe for guiding the refrigerant from the outdoor unit to the gas-liquid separator in the distributor, a second connection pipe for guiding the refrigerant from the distributor to the outdoor unit, and a switching part in the outdoor unit having a first four way valve provided to a discharge side of the compressor for selective switching of a flow direction of the refrigerant flowing in the outdoor heat exchanger, and a second four way valve provided to be switched in conformity with switching of the first four way valve for maintaining the first connection pipe as a high pressure section high pressure refrigerant flows therein, and the second connection pipe as a low pressure section low pressure refrigerant flows therein.

The first four way valve selectively switches between a state the discharge side of the compressor and the outdoor heat exchanger are connected, and a suction side of the compressor and the second four way valve are connected, and a state the discharge side of the compressor and the second four way valve are connected, and the suction side of the compressor and the outdoor heat exchanger are connected. The second four way valve selectively switches between a state the second connection pipe and the first four way valve are connected, and the first connection pipe and the outdoor heat exchanger are connected, and a state the second connection pipe and the outdoor heat exchanger are connected, and the first connection pipe and the first four way valve are connected.

The first connection pipe is designated to guide high pressure refrigerant from the second four way valve to the gas-liquid separator in the distributor by the switching part, and the second connection pipe is designated to guide low pressure refrigerant from the distributor to the four way valve by the switching part.

The first connection pipe has a diameter smaller than the second connection pipe. A plurality of compressors are connected in parallel for compressing the refrigerant.

The distributor includes the gas-liquid separator connected to the first connection pipe for separating the refrigerant from the first connection pipe depending on a phase of the refrigerant, a guide pipe part for guiding the refrigerant separated at the gas-liquid separator to the plurality of indoor unit depending on phases of the refrigerant, and guiding the refrigerant heat exchanged at the indoor units to the distributor again, and a valve part for controlling the guide pipe part so that the refrigerant is introduced only to selected indoor units out of the plurality of indoor units depending on operation conditions.

The guide pipe part includes a vapor pipe for guiding vapor phase refrigerant separated at the gas-liquid separator, vapor branch pipes branched from the vapor pipe and connected to the indoor units, a liquid pipe for guiding liquid phase refrigerant separated at the gas-liquid separator, liquid branch pipes branched from the liquid pipe and connected to the indoor units, cooling mode return branch pipes branched from the vapor branch pipes for returning the refrigerant heat exchanged at the indoor units selected depending on operation conditions, heating mode return branch pipes branched from the liquid refrigerant pipes for returning the refrigerant heat exchanged at the indoor units selected depending on operation conditions, and a return pipe for collecting refrigerant from the cooling/heating mode returning branch pipes, and guiding to the second connection pipe.

The valve part includes a cooling mode electronic expansion valve provided in a section of the liquid pipe between the gas-liquid separator and the heating mode return branch pipes for having an amount of opening thereof controlled depending on an operation condition, a heating mode electronic expansion valve provided to the heating mode return branch pipes for having an amount of opening thereof controlled depending of an operation condition, and two way valves provided to the vapor branch pipes, the liquid branch pipes, and the cooling mode return branch pipes, for being selectively turned on/off depending on operation conditions.

The vapor branch pipes and the liquid branch pipes are arranged in parallel to each other. The liquid branch pipes connected between the indoor heat exchangers and the distributor.

In a case all the indoor units are to cool the rooms, or a major number of the indoor units are to cool the rooms and rest of the indoor units are to heat the rooms, the first four way valve is switched to a state the discharge side of the compressor and the outdoor heat exchanger are connected, and the suction side of the compressor and the second four way valve are connected, and the second four way valve is switched to a state the second connection pipe and the first four way valve are connected, and the first connection pipe and the outdoor heat exchanger are connected.

In a case all the indoor units are to cool the rooms, the heating mode electronic expansion valve is closed fully, the cooling mode electronic expansion valve is opened fully, all the electronic expansion valves provided to the indoor units are controlled, all the two way valves connected to the vapor branch pipes are closed, and all the two way valves connected to the cooling mode return branch pipes and the liquid branch pipes are opened.

In a case a major number of the indoor units are to cool the rooms, and rest of the indoor units are to heat the rooms, the heating mode electronic valve is closed fully, and the cooling mode electronic expansion valve is controlled, and with regard to the indoor units which are to cool the rooms, the electronic expansion valves connected to the indoor heat exchangers are controlled, the two way valves connected to the vapor branch pipes are closed, and the two way valves connected to the cooling mode return branch pipes and the liquid branch pipes are opened, and with regard the indoor units which are to heat the rooms, the electronic expansion valves connected to the indoor heat exchangers are opened fully, the two way valves connected to the cooling mode return branch pipes are closed, and the two way valves connected to the vapor branch pipes and the liquid branch pipes are opened. The vapor refrigerant separated at the gas-liquid separator passes through the vapor pipe and the vapor branch pipes in succession, and introduced into indoor heat exchangers which to heat the rooms, and the high pressure refrigerant condensed at the indoor heat exchangers which to heat the rooms is discharged to the liquid pipe due to a pressure difference with the low pressure refrigerant which passes through the cooling mode electronic expansion valve, and flows in the liquid pipe.

In a case all the indoor units are to heat the rooms, or in a case a major number of the indoor units are to heat the rooms and rest of the indoor units are to cool the rooms, the first four way valve is switched to a state the discharge side of the compressor and the second four way valve are connected, and the suction side of the compressor and the outdoor heat exchanger are connected, and the second four way valve is switched to a state the second connection pipe and the outdoor heat exchanger are connected, and the first connection pipe and the first four way valve are connected.

In a case all the indoor units are to heat the rooms, the heating mode electronic expansion valve is controlled, and the cooling mode electronic expansion valve is closed fully, and all the electronic expansion valves provided to the indoor units are opened, all the two way valves connected to the vapor branch pipes and the liquid branch pipes are opened, and all the two way valves connected to the cooling mode return branch pipes are closed.

In a case a major number of the indoor units are to heat the rooms, and rest of the indoor units are to cool the rooms, the heating mode electronic valve is controlled, and the cooling mode electronic expansion valve is closed fully, and with regard to the indoor units which are to heat the rooms, the electronic expansion valves connected to the indoor heat exchangers are opened fully, the two way valves connected to the vapor branch pipes and the liquid branch pipes are closed, and the two way valves connected to the cooling mode return branch pipes are opened, and with regard the indoor units which are to cool the rooms, the electronic expansion valves connected to the indoor heat exchangers are controlled, the two way valves connected to the vapor branch pipes are closed, and the two way valves connected to the liquid branch pipes and the cooling mode return branch pipes are opened. The refrigerant passed through the indoor units which are to heat the rooms passes through the liquid branch pipes and the liquid pipe in succession, a portion of the refrigerant flows to the heating mode return branch pipes, and rest of the refrigerant is introduced into liquid branch pipes connected to the indoor units which are to cool the rooms.

In another aspect of the present invention, there is provided a method for operating a multi-type air conditioner, including the steps of switching a first foul way valve such that refrigerant discharged from the compressor is introduced into an outdoor heat exchanger following a first connection pipe, and switching a second four way valve such that refrigerant of a liquid phase or two phases condensed at the outdoor heat exchanger fully or partly is introduced into a gas-liquid separator following the first connection pipe, in a case all the indoor units are to cool the rooms or in a case a major number of the indoor units are to cool the rooms and rest of the indoor units are to heat the rooms, and switching the first four way valve such that refrigerant discharged from the compressor is introduced into the second connection pipe, and switching a second four way valve such that refrigerant is introduced from the second connection pipe into a gas-liquid separator following the first connection pipe, in a case all the indoor units are to heat the rooms or in a case a major number of the indoor units are to heat the rooms and rest of the indoor units are to cool the rooms.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the present invention, the same parts will be given the same names and reference symbols, and repetitive description of which will be omitted.

Figure 1:
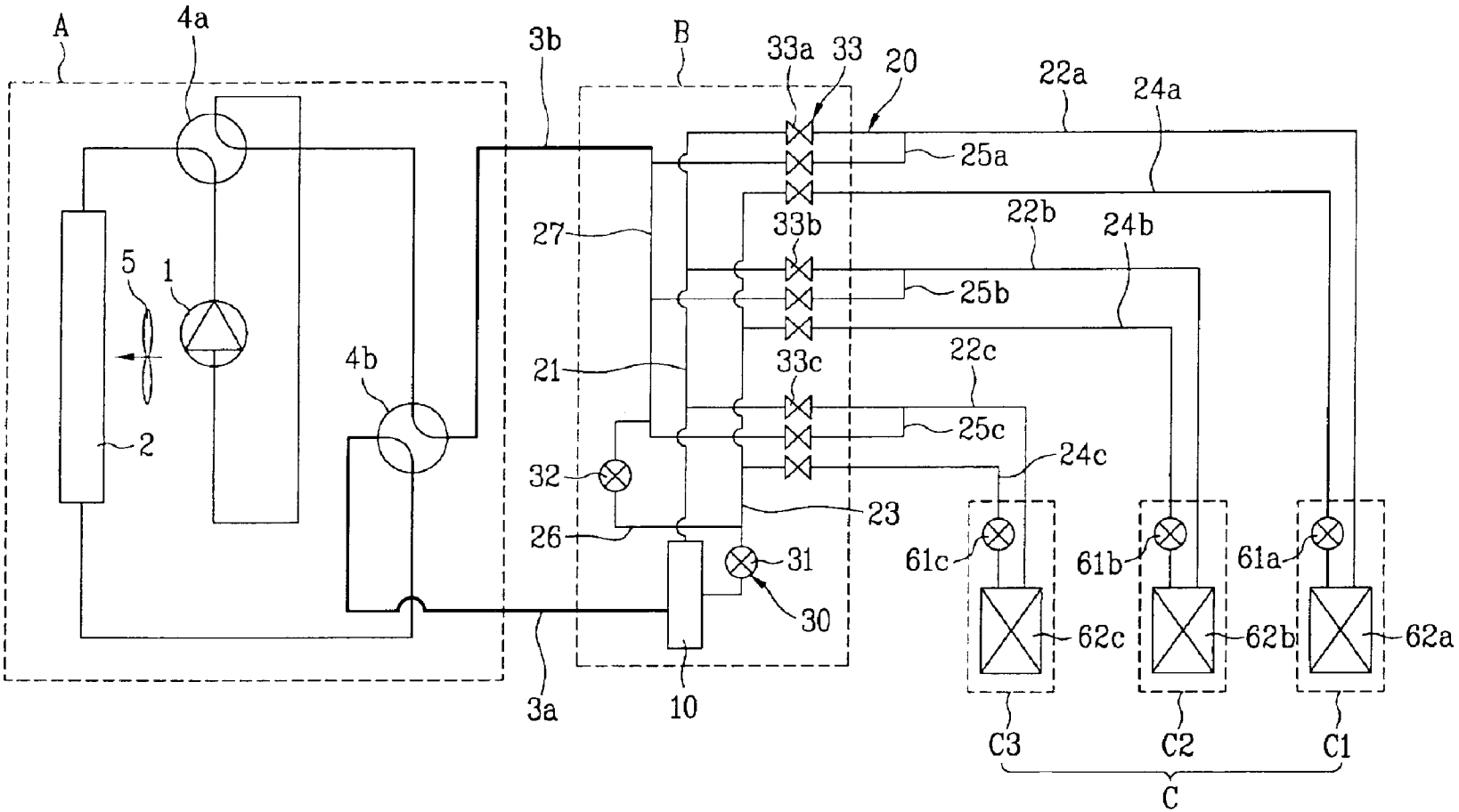
FIG. 1 illustrates a diagram of a multi-type air conditioner in accordance with a preferred embodiment of the present invention.

FIG. 1 illustrates a diagram of a multi-type air conditioner in accordance with a preferred embodiment of the present invention, wherein, for convenience of description, a reference symbol 22 represents reference symbols '22*a*, 22*b*, and 22*c*', 24 represents '24*a*, 24*b*, and 24*c*', and 25 represents '25*a*, 25*b*, and 25*c*. A reference symbol 61 represents '61*a*, 61*b*, and 61*c*, and 62 represents 62*a*, 62*b*, and 62*c*' However, it can be understood that a number of the reference symbols vary with a number of the indoor units.

The multi-type air conditioner includes an outdoor unit 'A', a distributor 'B'. and a plurality of indoor units C1, C2, and C3. The outdoor unit 'A' includes a compressor 1, four way valves 4*a*, and 4*b*, and outdoor heat exchanger 2. The distributor 'B' includes a gas-liquid separator 10, two expansion valves 31, and 32, and a plurality of refrigerant pipes. The plurality of indoor units C1, C2, and C3 include indoor heat exchangers 62*a*, 62*b*, and 62*c*, and electronic expansion valves 61*a*, 61*b* and 61*c*.

The multi-type air conditioner of the present invention can make a plurality of the indoor units to cool or heat rooms selectively, or, some of the indoor units to cool rooms. and rest of the indoor units to heat rooms. Since it is required to provide refrigerant from the outdoor unit 'A' to the plurality of indoor units 'C' selectively for simultaneous cooling and heating, a complicate distributor 'B' is required. Therefore, for simplifying the distributor 'B', the present invention simplifies a pipeline for guiding the refrigerant from the outdoor unit 'A' to the distributor 'B' and a pipeline for guiding refrigerant from the distributor 'B' to the outdoor unit 'A'.

Referring to FIG. 1, a second connection pipe 3*b* for guiding the refrigerant from the outdoor unit 'A' to the gas-liquid separator 10 in the distributor 'B', and a first connection pipe 3*a* for guiding the refrigerant from the distributor 'B' to the outdoor unit 'A' are respectively designated to serve the same functions always. That is, it is preferable that the first connection pipe 3*a* is designated only to guide high pressure refrigerant, and the second connection pipe 3*b* is designated only to guide low pressure refrigerant. The designation of functions of the second connection pipe 3*b* and the first connection pipe 3*a* simplifies an entire pipe system because a pipe arrangement of the distributor "B" can be the same regardless of cooling or heating.

A system of the present invention for fixing pressure states of the refrigerant flowing in the first connection pipe and the second connection pipe will be described in detail.

The outdoor unit 'A' of the present invention includes a compressor 1, an indoor heat exchanger 2, switching part 4*a* and 4*b*, a second connection pipe 3*b* and a first connection pipe 3*a* connected between the outdoor unit and the distributor. The second connection pipe 3*b* connects a return pipe 27 in the distributor to the second four way valve 4*b* in the outdoor unit. The first connection pipe 3*a* connects the second four way valve 4*b* of the outdoor unit to the gas-liquid separator 10 in the distributor 'B'. A flow direction of the refrigerant is changed at the switching parts 4*a* and 4*b* so that the second connection pipe 3*b* is designed as a lower pressure section and the first connection pipe 3*a* is designated as a high pressure section.

The switching parts includes a first four way valve 4*a* and a second four way valve 4*b*, each having two inlets and two outlets. One of the inlets is made to communicate with one of the outlets, to form two flow passages in overall. Connection states of the outlets and the inlets are exchanged in response to a switching signal or the like. Therefore, the four way valves are used for selective change of a flow direction of the refrigerant flowing inside of the four way valves.

It is preferable that the first four way valve 4*a* is provided at a position adjacent to the discharge side of the compressor 1, and the second four way valve 4*b* is provided at a position a distance between the four way valve 4*b* and the distributor 'B' outside of the outdoor unit 'A' is the shortest.

The first four way valve 4*a* changes a flow direction of the refrigerant flowing inside of the outdoor heat exchanger 2 in view of a relation between the compressor 1 and the outdoor unit 2.

A principle the four way valve 4*a* changes a direction of the refrigerant flowing to the outdoor heat exchanger 2 will be described in detail. In general, for cooling and heating, the refrigerant circulates in an order of compressor—condenser—expansion valve—evaporator in a thermodynamic cycle. In heating a room the indoor heat exchanger 62 works as a condenser, and the outdoor heat exchanger 2 works as an evaporator. Opposite to this, when the room is cooled, the indoor heat exchanger 62 works as an evaporator, and the outdoor heat exchanger 2 works as a condenser. When the function of the heat exchanger is described with reference to the compressor 1, a heat exchanger connected to a refrigerant discharge side of the compressor 1 works as a condenser, and a heat exchanger connected to a refrigerant inlet side of the compressor works as an evaporator.

Therefore, if the flow direction of the refrigerant inside of the outdoor heat exchanger 2 is changed, the cooling and heating by the indoor unit C1, C2, and C3 can be carried out selectively. Since circulation of the refrigerant is made by operation of the compressor, it is required to provide a device for changing the flow direction of the refrigerant at the refrigerant outlet of the compressor 1. In the present invention, as the device for changing the flow direction of the refrigerant in the outdoor heat exchanger, the first four way valve 4*a* is provided.

Figure 2A:
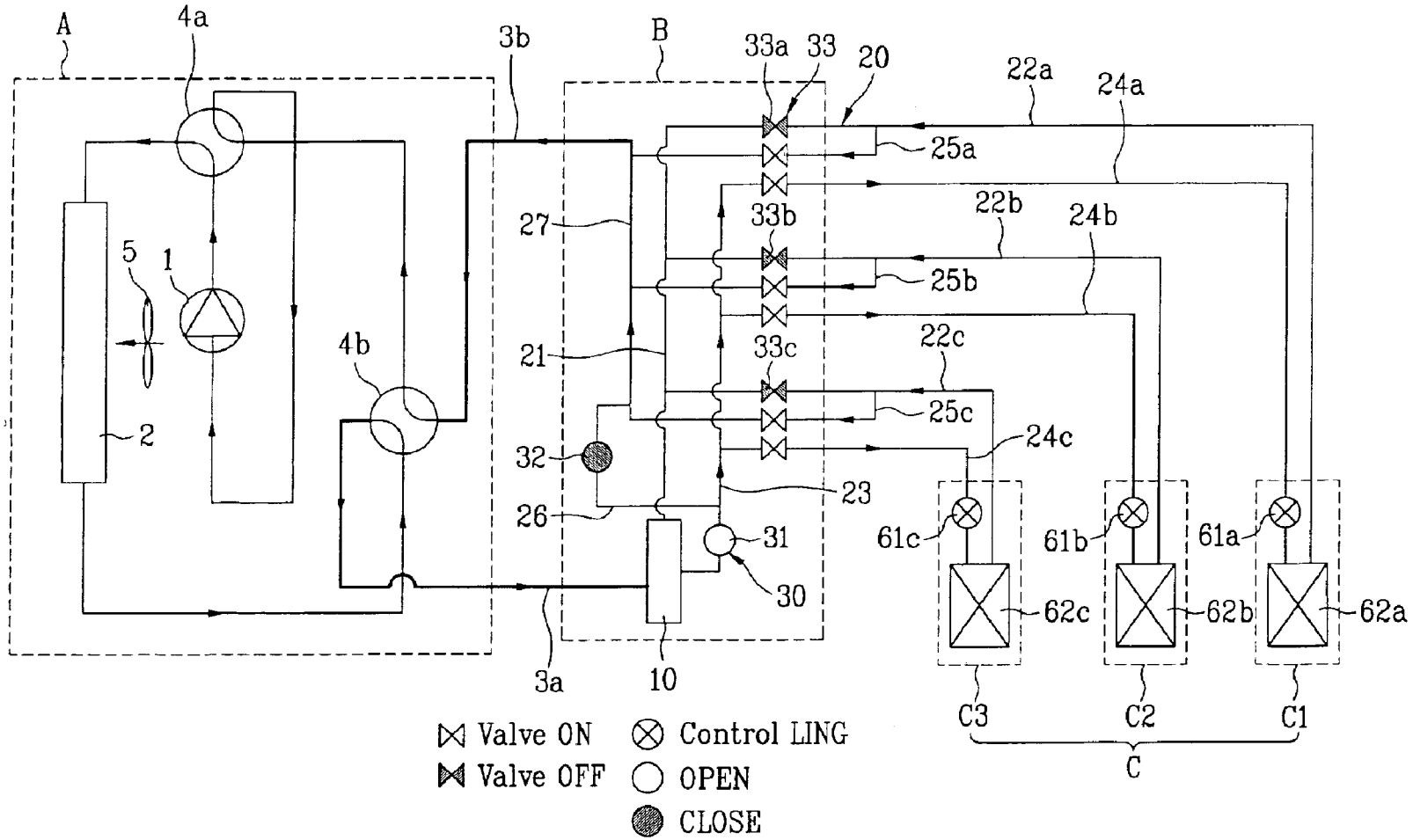
FIG. 2A illustrates an operational diagram of the multi-type air conditioner in FIG. 1 when all indoor units are in cooling.
Figure 3A:
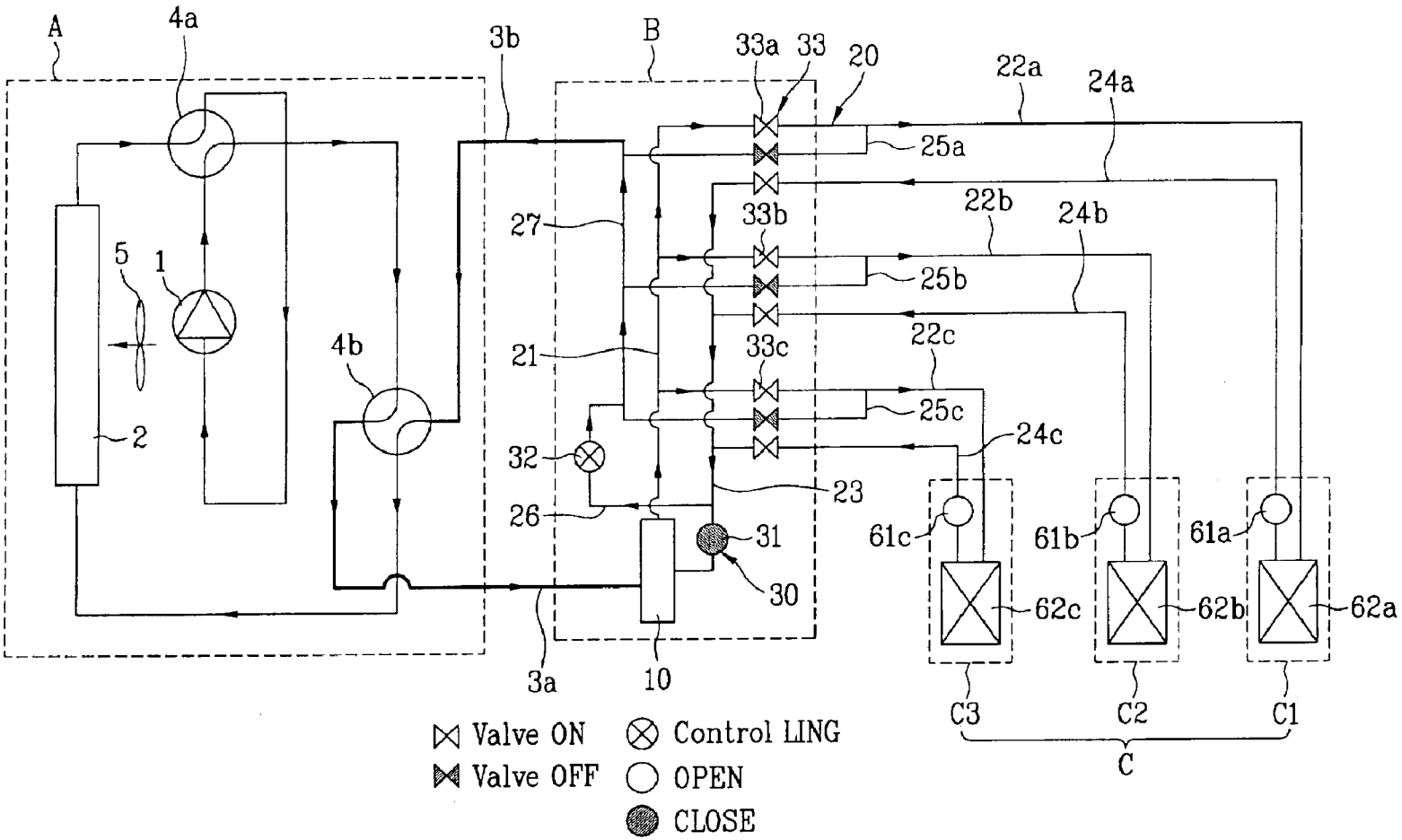
FIG. 3A illustrates an operational diagram of a multi-type air conditioner in FIG. 1 when all indoor units are in heating.

Referring to FIG. 2A, the first four way valve 4*a* forms a flow path connecting the discharge side of the compressor 1 to the outdoor heat exchanger 2, and a flow path connecting a suction side of the compressor 1 to the second four way valve 4*b*. A state the first four way valve 4*a* is switched for changing the flow direction of the refrigerant is illustrated in FIG. 3A. Referring to FIG. 3A, the first four way valve 4*a* is switched to a flow path connecting the discharge side of the compressor 1 and the second four way valve 4*b*, and a flow path connecting the suction side of the compressor 1 and the outdoor heat exchanger 2. According to this, in FIG. 2A, the outdoor heat exchanger 2 functions as a condenser, and the indoor unit functions as a cooler. Opposite to this in FIG. 3A, the outdoor heat exchanger 2 functions as an evaporator, and the indoor heat exchanger functions as a heater.

In the meantime, the second four way valve 4*b* is provided as means for maintaining the first connection pipe 3*a* as a high pressure section the high pressure refrigerant flows therein and the second connection pipe 3*b* for maintaining the second connection pipe 3*b* as a low pressure section the low pressure refrigerant flows therein in conformity with the switching of the first four way valve 4*a*.

Referring to FIG. 2A, the second four way valve 4*b* forms a flow path connecting the second connection pipe 3*b* and the first four way value 3*a*, and a flow path connecting the first connection pipe 3*a* and the outdoor heat exchanger 2. A state the second four way valve 4*b* is switched is illustrated in FIG. 3A. Referring to FIG. 3A, the second four way valve 4*b* is switched in conformity with the switching of the first four way valves 4*a*, to a flow path connecting the second connection pipe 3*b* and the outdoor heat exchanger 2, and a flow path connecting the first connection pipe 3*a* and the first four way valve 4*a*. The switching of the second four way valve 4*b* facilitates maintenance of the second connection pipe 3*b* as the low pressure section and the first connection pipe 3*a* as the high pressure section.

That is, referring to FIG. 2A, the refrigerant discharged from the compressor 1 passes through the outdoor heat exchanger 2, working as a condenser, and is introduced into the first connection pipe 3*a* through the second four way valve 4*b*, as described before, the refrigerant in the first connection pipe 3*a* is in a high pressure state, and the refrigerant flowing in the second connection pipe 3*b*, passing through the expansion valve 61, the indoor heat exchanger 62, and the return pipe 27, is in a low pressure state.

Thus, by switching the second four way valve 4*b* in conformity with the switching of the first four way valve 4*a*, the refrigerant pressure states of the first connection pipe 3*a* and the second connection pipe 3*b* can be maintained. If only the first four way valve 4*a* is switched, and the second four way valve 4*b* is not switched though the refrigerant flow direction in the outdoor heat exchanger 2 chances, the refrigerant in the first connection pipe 3*a* is in a low pressure state, and the refrigerant in the second connection pipe 3*b* is in a high pressure state. Consequently, since it is required to chance a pipe system of the distributor 'B' in correspondence to the change of refrigerant states in the first connection pipe 3*a* and the second connection pipe 3*b*, the pipe system of the distributor 'B' will become complicate.

Opposite to this, the present invention suggests switching of the second four way valve 4*b* in conformity with switching of the first four way valve 4*a* depending on operation conditions. According to this, the first connection pipe 3*a* connecting between the second four way valve 4*b* and the gas-liquid separator 10 is maintained as a high pressure section HP only high pressure state refrigerant flows therein. Moreover, the second connection pipe 3*b* from the distributor 'B' to a side of the second four way valve 4*b* the refrigerant is introduced thereto is maintained as a low pressure section LP only low pressure state refrigerant flows therein. As the refrigerant pressure states of the first connection pipe 3*a* and the second connection pipe 3*b* are designated, a pipe system of the distributor 'B' can be simplified.

In this instance, it is preferable that a pipe diameter of the first connection pipe 3*a* is smaller than the second connection pipe 3*b*. This is for making mass flow rates in the first connection pipe 3*a* and the second connection pipe 3*b* the same despite of a specific volume difference of the high pressure refrigerant and the low pressure refrigerant. That is, as a specific volume of the high pressure refrigerant is smaller than the low pressure refrigerant, a pipe diameter of the high pressure section is made small than a pipe diameter of the low pressure section, for improving an air conditioning efficiency.

Meanwhile, the multi-type air conditioner has a system for cooling, or heating a plurality of indoor units 'C', to require a great mass flow rate of refrigerant the compressor 1 requires to discharge. Therefore, if compression with one compressor is not appropriate, it is preferable that a plurality of compressors are connected in parallel, for discharging refrigerant from the compressors together for an efficient compression of the refrigerant.

The refrigerant from the outdoor unit 'A' is introduced into the distributor 'B', passes through the gas-liquid separator 10, and guided to a plurality of indoor units selectively depending on conditions of cooling, heating and cooling/heating. As described, since the first connection pipe 3*a*, the high pressure section HP, and the second connection pipe 3*b*, the low pressure section LP, are designated and connected to the distributor 'B', the distributor 'B' system becomes much simpler. That is, since the pipe system of the distributor 'B' is not necessary to change depending on an operation condition, many pipes can be simplified.

The distributor 'B' includes the gas-liquid separator 10, a guide pipe part 20, and a valve part 30. The gas-liquid separator 10, connected to the first connection pipe 3*a*, separates phases of the refrigerant introduced thereto from the outdoor unit 'A'. The guide pipe part 20 guides the refrigerant separated at the gas-liquid separator 10 to the indoor units C1, C2, and C3 selectively depending on phases of the refrigerant, and guides heat exchanged refrigerant to the distributor 'B' again. The valve part 30 controls the guide pipe part 20 so that the refrigerant flows only to indoor units selected from the plurality of indoor units C1, C2, and C3 according to operation conditions.

The guide pipe part 20 includes a vapor pipe 21, vapor branch pipes 22, liquid tube 23, liquid branch pipes 24, return branch pipes, and a return pipe 27.

Referring to FIG. 1, the vapor pipe 21 guides vapor phase refrigerant separated at the gas-liquid separator 10. The vapor branch pipes 22 are branched from the vapor pipe 21 and connected to the indoor heat exchangers 62 of the indoor units 'C'. The liquid pipe 23 guides liquid phase refrigerant separated at the gas-liquid separator 10. The liquid branch pipes 24 are branched from the liquid pipe 23, and are connected to the indoor heat exchangers 62 of the indoor units 'C'.

The return branch pipes have cooling mode return branch pipes 25 and heating mode return branch pipes 26. The cooling mode return branch pipes 25 are branched from the vapor branch pipes 22 for guiding refrigerant, heat exchanged at indoor units 'C' selected depending on operation conditions, to the return pipe 27. The heating mode return branch pipes 26 are branched from the liquid refrigerant pipes for returning the refrigerant heat exchanged at the indoor units 'C' selected depending on operation conditions to the outdoor unit through the return pipe 27. The refrigerant returns from the return branch pipes 25 and 26 to the return pipe 27, and is guided to the second connection pipe 3*b*.

It is preferable that the vapor branch pipes 22 and the liquid branch pipes 24 are lead to run in parallel. That is, the vapor branch pipes 22 and the liquid branch pipes 24, connecting the distributor 'B' and the plurality of indoor unit 'C', are lead to run in parallel within a fixed duct (not shown) for better outer appearance. Accordingly, by putting the vapor branch pipes 22 and the liquid branch pipes 24 in the fixed duct as one set in production, piping work can be made easy.

Meanwhile, the multi-type air conditioner of the present invention includes the valve part 30 for controlling the guide pipe part 20. The valve part 30 includes a cooling mode electronic expansion valve 31, a heating mode electronic expansion valve 32, and a plurality of two way valves 33.

The cooling mode electronic expansion valve 31 is provided in a section of the liquid pipe 23 between the gas-liquid separator 10 and a heating mode return branch pipe 26, and an amount of opening of which is controlled according to an operation condition. The heating mode electronic expansion valve 32 is provided to a heating mode return pipe 26, and an opening amount of which is controlled according to an operation condition.

The plurality of two way valves 33 are provided to the vapor branch pipes 22, the liquid branch pipes 24, and the cooling mode return branch pipes 25, and being turned on/off depending on operation conditions. In addition to this, there is an electronic expansion valve 61 provided to each of the liquid branch pipe 24 connected to each of the indoor units 'C'.

In the meantime, each of the indoor units 'C' connected to the distributor 'B' includes the indoor heat exchanger 62 connected both to the vapor branch pipe 22 and the liquid branch pipe 24, and the electronic expansion valve 61 connected to the liquid branch pipe 24.

Of the system of the outdoor unit 'A', the distributor 'B', and the indoor unit 'C', when the electronic expansion valves 61 provided to the switching part, the valve part 30, and the indoor heat exchanger 62 are controlled appropriately, the refrigerant flows meeting to the operation conditions of the air conditioner.

The multi-type air conditioner of the present invention controls the refrigerant flow direction by switching the four way valves 4*a* and 4*b* at the switching part according to an operation condition.

That is, when all the indoor units C1, C2, and C3 are to cool the rooms, or a major number of the indoor unit C1, C2, and C3 are to cool the rooms, and rest of the indoor unit C1, C2, and C3 are to heat the rooms, the first four way valve 4*a* is switched so as to connect the discharge side of the compressor 1 and the outdoor heat exchanger 2, and the suction side of the compressor 1 and the second four way valve 4*b*. At the same time with this, the second four way valve 4*b* is switched so as to connect the second connection pipe 3*b* and the first four way valve 4*a*, and the first connection pipe 3*a* and the outdoor heat exchanger 2.

Opposite to this, when all the indoor units C1, C2, and C3 are to heat the rooms or a major number of the indoor unit C1, C2, and C3 are to heat the rooms, and rest of the indoor unit C1, C2, and C3 are to cool the rooms, the first four way valve 4*a* is switched so as to connect the discharge side of the compressor 1 and the four way valve 4*b*, and the suction side of the compressor 1 and the outdoor heat exchanger 2. At the same time with this, the second four way valve 4*b* is switched so as to connect the second connection pipe 3*b* and the outdoor heat exchanger 2, and the first connection pipe 3*a* and the first four way valve 4*a*.

The operation of the foregoing multi-type air conditioner of the present invention will be described with reference to FIGS. 2A~3B.

First, a case when all the indoor units C1, C2, and C3 are operated in cooling mode will be described.

Referring to FIG. 2A, vapor refrigerant from the compressor 1 is introduced into, and condensed at the outdoor heat exchanger 2 as the first four way valve 4*a* is switched. For condensing the refrigerant flowing in the outdoor heat exchanger 2, the fan 5 is put into operation, to blow external air toward the outdoor heat exchanger 2.

The condensed liquid refrigerant is introduced into the gas-liquid separator 10 following the first connection pipe 3*a* as the second four way valve 4*b* is switched. The high pressure/liquid state refrigerant introduced into the gas-liquid separator 10 passes through the liquid pipe 23 and the liquid branch pipes 24, expands as the refrigerant passes through the electronic expansion valve 61, and evaporates as the refrigerant passes through the indoor heat exchanger 62, to cool the rooms.

Then, the evaporated refrigerant moves following the vapor branch pipes 22 until the two way valve 33 blocks the movement, when the refrigerant introduced into the second connection pipe 3*b*, passing through the return branch pipes 25 and the return pipe 27 in succession.

The refrigerant introduced into the second connection pipe 3*b* passes through the second four way valve 4*b* and the first four way valve 4*a*, switched already, and is drawn into the compressor 1.

Second, a case when a major number of the indoor units C1, C2, and C3 are to cool the rooms, and rest of the indoor units C1, C2, and C3 are to heat the rooms will be described.

Figure 2B:
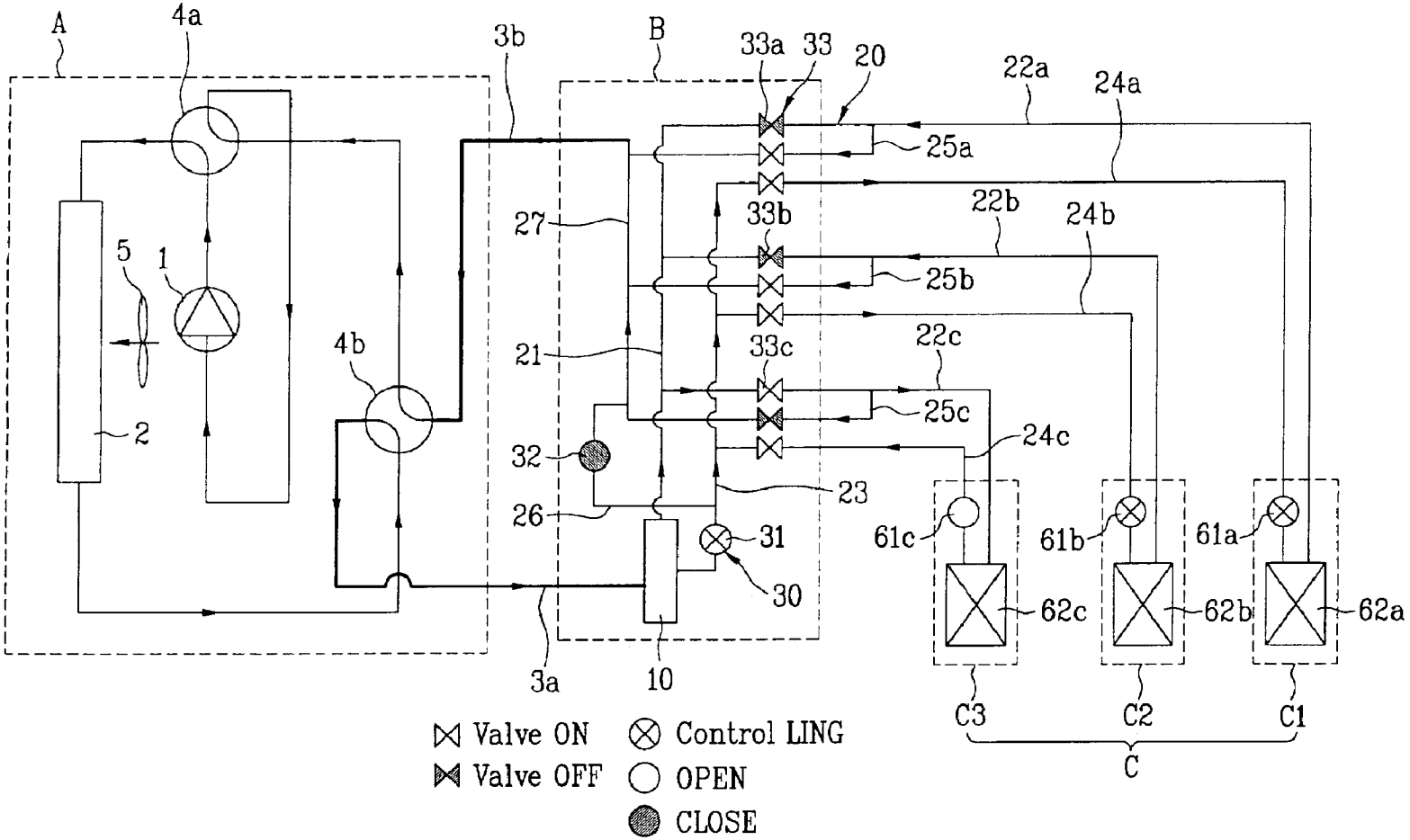
FIG. 2B illustrates an operational diagram of a multi-type air conditioner in FIG. 1 when major number of the indoor units are in cooling and rest of the air conditioners are in heating.

Referring to FIG. 2B, the vapor refrigerant from the compressor 1 is introduced into the outdoor heat exchanger 2 as the first four way valve 4*a* is switched. In this instance, different from a case when all the indoor units cool the rooms, an air blowing rate of the fan is controlled, so that a portion of the refrigerant is not condensed, but kept as vapor. The two phased refrigerant from the outdoor heat exchanger 2 is introduced into the gas-liquid separator 10 following the first connection pipe 3*a* as the second four way valve 4*b* is switched.

The liquid refrigerant separated at the gas-liquid separator 10 is introduced into the liquid pipe 23, therefrom branched to the first and second liquid branch pipes 24*a* and 24*b* connected to the indoor units C1 and C2 that require cooling, passes and expanded through the first and second electronic expansion valves 61*a* and 61*b* connected to the liquid branch pipes 24*a* and 24*b* respectively, and passes and vaporizes through the first and second indoor heat exchangers 62*a* and 62*b*, to cool the rooms.

At the same time with this, the vapor refrigerant separated at the gas-liquid separator 10 is introduced into the vapor pipe 21, and therefrom to the third vapor branch pipe 22*c* connected to the indoor unit C3 that is to heat the room. Then, the refrigerant is condensed as the refrigerant passes through the third indoor heat exchanger 62*c* and heats the room. The condensed refrigerant passes through the opened third electronic expansion valve 61*c* and the third liquid branch pipe 24*c*, and joins with the liquid pipe 23.

Accordingly, the liquid refrigerant condensed at the first indoor heat exchanger 62*c* joins with the liquid refrigerant separated at the gas-liquid separator 10 at the liquid pipe 23, and introduced into the first and second liquid branch pipes 24*a* and 24*b*. Thereafter, the liquid refrigerant passes through and expands at the first and second expansion valves 61*a* and 61*b*, passes through and evaporates at the first and second indoor heat exchangers 62*a* and 62*b* provided to the indoor units C1 and C2 that require cooling, to cool down a plurality of room that require cooling.

In this instance, the liquid refrigerant condensed at the third indoor heat exchanger 62*c* flows, not in a reverse direction, but forward direction toward the liquid pipe 23, because of a pressure difference of the refrigerant. That is, the liquid refrigerant separated at the gas-liquid separator 10 is expanded, and involved in a pressure drop, the liquid refrigerant has a pressure lower than the refrigerant from the third liquid branch pipe 24*c*.

Then, the vaporized low pressure refrigerant flows following the first and second vapor branch pipes 22*a* and 22*b*. The refrigerant is introduced into the second connection pipe 3*b* through the first and second cooling mode return branch pipes 25*a* and 25*b* and the return pipe 27 in succession owing to the closed first and second two way valves 33*a* and 33*b*.

The refrigerant introduced into the second connection pipe 3*b* is drawn to the compressor 1 as the refrigerant passes through the second four way valve 4*b* and the first four way valve 4*a* which are switch already.

Third, a case when all the indoor units C1, C2 and C3 are to heat the rooms will be described.

Referring to FIG. 3A, vapor refrigerant from the compressor 1 introduced into the first connection pipe 3*a* after passing through the second four way valve 4*b* without passing through the outdoor heat exchanger 2 as the first four way valve 4*a* is switched. The vapor refrigerant passes the first connection pipe 3*a* and is guided to the gas-liquid separator 10.

The high pressure/vapor refrigerant is introduced from the gas-liquid separator 10 to the vapor pipe 21, branched into the vapor branch pipes 22, and pass through, and condensed at the indoor heat exchangers 62 as the rooms are heated.

Then, the condensed refrigerant passes through the opened electronic expansion valve 61, the liquid branch pipes 24, the liquid pipe 23, and the heating mode return branch pipe 26, is expanded at the heating mode electronic expansion valve 32, and introduced into the second connection pipe 3*b* following the return pipe 27.

The refrigerant is introduced from the second connection pipe 3*b* to the outdoor heat exchanger 2 through the second four way valve 4*b* switched already. The refrigerant heat exchanges with external air, and is evaporated at the outdoor heat exchanger 2 owing to driving of the fan 5, and drawn toward the compressor 1 through the first four way valve 4*a* switched, already.

Fourth, a case when a major number of the indoor units C1, C2, and C3 are to heat the rooms and rest of the indoor units are to cool the room will be described.

Figure 3B:
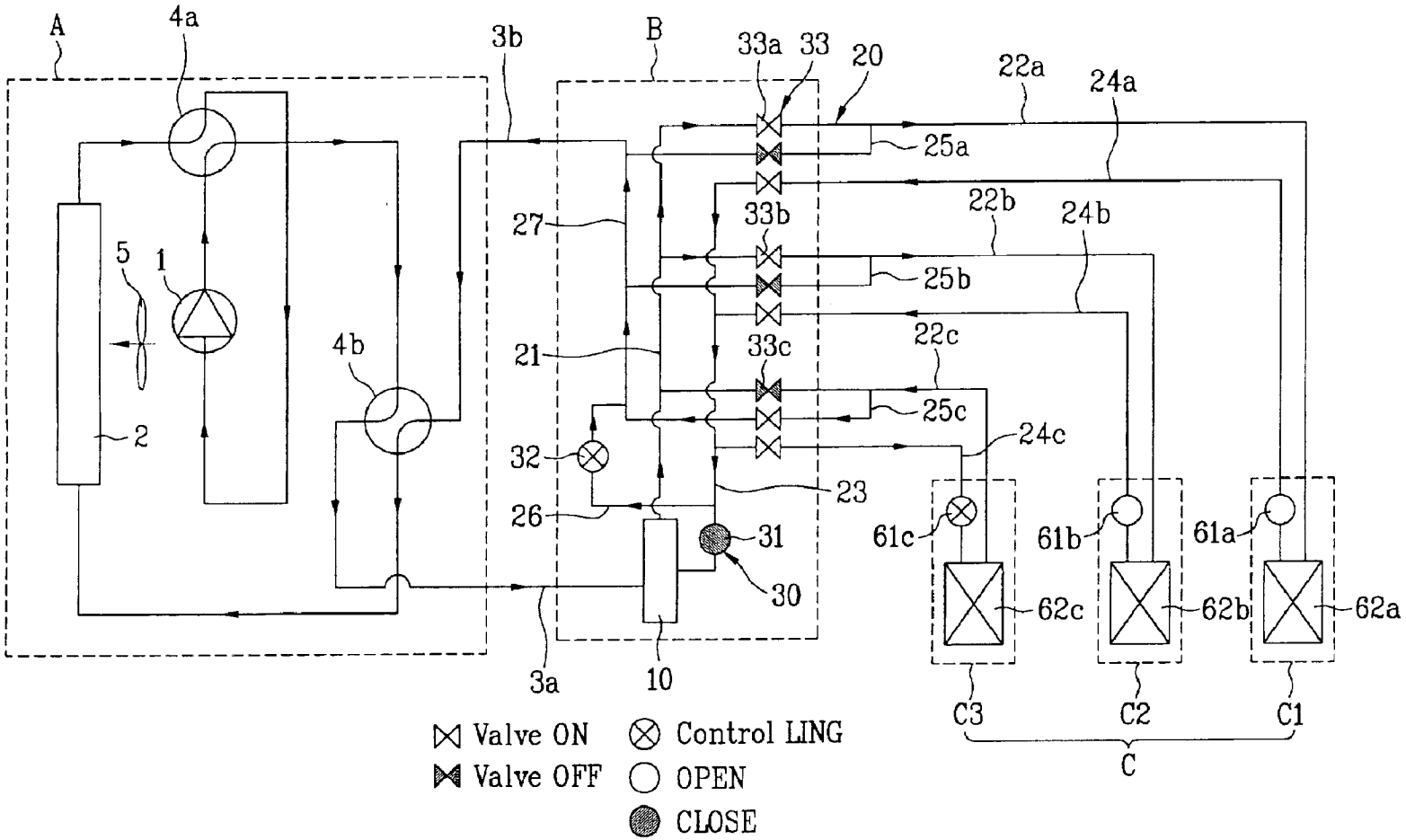
FIG. 3B illustrates an operational diagram of a multi-type air conditioner in FIG. 1 when major number of the indoor units are in heating and rest of the air conditioners are in cooling.

Referring to FIG. 3B, the vapor refrigerant from the compressor 1 is introduced into the second four way valve 4*b* in a high pressure state without passing through the outdoor heat exchanger 2, and therefrom to the gas-liquid separator 10 following the first connection pipe 3*a* as the first four way valve 4*a* is switched.

The high pressure/liquid refrigerant is introduced from the gas-liquid seperator 10 to the vapor pipe 21, and branched to the first and second vapor branch pipes 22*a* and 22*b* connected to the indoor units C1 and C2 that require heating the rooms. The refrigerant passed through the first and second vapor branch pipes 22*a* and 22*b*, heats a plurality of rooms that require heating as the refrigerant passes through, and condensed at the first and second indoor heat exchangers 62*a* and 62*b*.

The condensed refrigerant passes the opened first and second electronic expansion valves 61*a* and 61*b*, the first and second liquid branch pipes 24*a* and 24*b*, and the liquid pipe 23 in succession.

In this instance, a portion of the condensed refrigerant passes through the heating mode return branch pipe 26, expands at the heating mode electronic expansion valve 32, and introduced into the second connection pipe 3*b* following the return pipe 27.

At the same time with this, the other portion of the condensed refrigerant is introduced into the selected third liquid branch pipe 24*c*, passes through and expands at the third electronic expansion valve 61*c*, and passes through and evaporates at the third indoor heat exchanger 62*c*, to cool the room that requires cooling. Then, the vapor refrigerant flows following the third vapor branch pipe 22*c* until blocked by the third two way valve 33*c*, when the vapor refrigerant passes the third cooling mode return branch pipe 25*c* and the return pipe 27 in succession, and introduced into the second connection pipe 3*b*. The condensed refrigerant flows, not to the liquid branch pipes 24*a* or 24*b* on a side where heating is required reversely, but to the liquid branch pipe 24*c* on a side where cooling is required, because of a pressure difference. In detail, a pressure of the liquid branch pipe 24*a* or 24*b* connected to the indoor unit C1 or C2 which requires heating is higher than a pressure of the liquid branch pipe 24*c* connected to the indoor unit C3 which requires cooling.

Thereafter, the refrigerant introduced into the second connection pipe 3*b* passes through the second four way valve 4*b* which is switched already, and introduced into, and evaporated at the outdoor heat exchanger 2. Then, the refrigerant passes through the first four way valve 4*a* and is drawn to the compressor 1, continuously.

As has been described, the multi-type air conditioner of the present invention facilitates optimal dealing with environments of respective rooms. That is, not only an operation in which all rooms are heated or cooled is possible, but also an operation in which some of the rooms are cooled, and rest of the rooms are heated is also possible. An optimal dealing with a latter case is possible depending on whether a number of rooms that require cooling is greater or a number of rooms that require heating is greater.

Moreover, by simplifying and designating the piping system, like the first and second connection pipes 3*a* and 3*b* connected to the outdoor unit 'A', an efficiency of the air conditioner can be improved, and a fabrication process of the air conditioner can be simplified, thereby dropping a production cost. Furthermore, the different pipe diameters of the first and second connection pipes 3*a* and 3*b* permits to prevent non-uniform refrigerant flow rate caused by variation of a specific volume.

As has been described, the multi-type air conditioner, and the method for operating the same of the present invention have the following advantages.

First, optimal dealing with individual room environments is possible. A case a plurality of rooms show temperature differences depending on positions and times, or a case of computer room that requires cooling, not only in summer, but also in winter can also be dealt with.

Second, the use of the four way valves which simplifies a piping system and reduces a pressure loss permits to improve the air conditioner efficiency, simplify a fabrication process, and drop a production cost.

Third, the diameter of the high pressure section of the first connection pipe made smaller than the diameter of the low pressure section of the second connection pipe permits to prevent occurrence of non-uniform flow rates between low pressure refrigerant with a great specific volume and high pressure refrigerant with a small specific volume.

Fourth, the parallel vapor branch pipes and the liquid branch pipes, which connect the distributor and the indoor units, simplifies piping work. Moreover, by putting the pipes into one duct, an outer appearance can be improved.

Fifth, the employment of two way valves, each of which has a low price than a four way valve, in controlling the distributor reduces a production cost.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A multi-type air conditioner comprising:

an outdoor unit installed outside of a room having a compressor and an outdoor heat exchange mounted therein;

a plurality of indoor units, each installed in a room, having an electronic expansion valve and an indoor heat exchanger;

a distributor that separates refrigerant from the outdoor unit at a gas-liquid separator and guides separated refrigerant to the plurality of indoor units selectively depending on operation conditions;

a first connection pipe that guides the refrigerant from the outdoor unit to the gas-liquid separator in the distributor;

a second connection pipe that guides the refrigerant from the distributor to the outdoor unit; and a switching part in the outdoor unit having a first four way valve provided to a discharge side of the compressor that selectively switches a flow direction of the refrigerant flowing in the outdoor heat exchanger, and a second four way valve configured to switch in conformity with switching of the first four way valve to maintain the first connection pipe as a high pressure section where high pressure refrigerant flows, and the second connection pipe as a low pressure section where low pressure refrigerant flows.

2. The multi-type air conditioner as claimed in claim 1, wherein the first four way valve selectively switches between a condition that the discharge side of the compressor and the outdoor heat exchanger are connected, and a suction side of the compressor and the second four way valve are connected, and a condition that the discharge side of the compressor and the second four way valve are connected, and the suction side of the compressor and the outdoor heat exchanger are connected.

3. The multi-type air conditioner as claimed in claim 1, wherein the second four way valve selectively switches between a condition that the second connection pipe and the first four way valve are connected, and the first connection pipe and the outdoor heat exchanger are connected, and a condition that the second connection pipe and the outdoor heat exchanger are connected, and the first connection pipe and the first four way valve are connected.

4. The multi-type air conditioner as claimed in claim 1, wherein the first connection pipe is configured to guide high pressure refrigerant from the second four way valve to the gas-liquid separator in the distributor by the switching part, and the second connection pipe is configured to guide low pressure refrigerant from the distributor to the four way valve by the switching part.

5. The multi-type air conditioner as claimed in claim 1, wherein the first connection pipe has a diameter smaller than the second connection pipe.

6. The multi-type air conditioner as claimed in claim 1, wherein a plurality of compressors are connected in parallel to compress the refrigerant.

7. The multi-type air conditioner as claimed in claim 1, wherein the distributor comprises;

the gas-liquid separator connected to the first connection pipe, that separates the refrigerant from the first connection pipe depending on a state of the refrigerant, a guide pipe part that guides the refrigerant separated at the gas-liquid separator to the plurality of indoor units depending on states of the refrigerant, and guides the refrigerant heat-exchanged at the indoor units back to the distributor, and a valve part that controls the guide pipe part so that the refrigerant is introduced only to selected indoor units out of the plurality of indoor units depending on operation conditions.

8. The multi-type air conditioner as claimed in claim 7, wherein the guide pipe part comprises;

a vapor pipe that guides vapor-state refrigerant separated at the gas-liquid separator, a plurality of vapor branch pipes branched from the vapor pipe and connected to the indoor units;

a liquid pipe that guides liquid-state refrigerant separated at the gas-liquid separator;

a plurality of liquid branch pipes branched from the liquid pipe and connected to the indoor units;

a plurality of cooling mode return branch pipes branched from the vapor branch pipes, that return the refrigerant heat-exchanged at the indoor units selected depending on operation conditions;

a plurality of heating mode return branch pipes branched from the liquid refrigerant pipes, that return the refrigerant heat-exchanged at the indoor units selected depending on operation conditions; and a return pipe that collects refrigerant from the cooling/heating mode return branch pipes, and guides to the second connection pipe.

9. The multi-type air conditioner as claimed in claim 8, wherein the valve part includes;

a cooling mode electronic expansion valve, provided in a section of the liquid pipe between the gas-liquid separator and the heating mode return branch pipes, that has an amount of opening thereof controlled depending on an operation condition, a heating mode electronic expansion valve provided to the heating mode return branch pipes, that has an amount of opening thereof controlled depending on operation conditions, and two way valves provided to the vapor branch pipes, the liquid branch pipes, and the cooling mode return branch pipes, that are selectively turned on/off depending on operation conditions.

10. The multi-type air conditioner as claimed in claim 8, wherein the vapor branch pipes and the liquid branch pipes are arranged in parallel to each other.

11. The multi-type air conditioner as claimed in claim 8, wherein the electronic expansion valve provided to each indoor unit is fitted to each of the liquid branch pipes connected between the indoor heat exchangers and the distributor.

12. The multi-type air conditioner as claimed in claim 9, wherein, in a condition where all the indoor units are configured to cool the rooms, or where a major number of the indoor units are configured to cool the rooms and rest of the indoor units are configured to heat the rooms, the first four way valve is switched to a state that the discharge side of the compressor and the outdoor heat exchanger are connected, and the suction side of the compressor and the second four way valve are connected, and the second four way valve is switched to a state that the second connection pipe and the first four way valve are connected, and the first connection pipe and the outdoor heat exchanger are connected.

13. The multi-type air conditioner as claimed in claim 12, wherein, in a condition where all the indoor units are configured to cool the rooms, the heating mode electronic expansion valve is closed fully, the cooling mode electronic expansion valve is opened fully, all the electronic expansion valves provided to the indoor units are controlled, all the two way valves connected to the vapor branch pipes are closed, and all the two way valves connected to the cooling mode return branch pipes and the liquid branch pipes are opened.

14. The multi-type air conditioner as claimed in claim 12, wherein, in a condition where a major number of the indoor units are configured to cool the rooms, and rest of the indoor units are to heat the rooms, the heating mode electronic valve is closed fully, and the cooling mode electronic expansion valve is controlled, and with regard to the indoor units which are configured to cool the rooms, the electronic expansion valves connected to the indoor heat exchangers are controlled, the two way valves connected to the vapor branch pipes are closed, and the two way valves connected to the cooling mode return branch pipes and the liquid branch pipes are opened, and with regard the indoor units which are configured to heat the rooms, the electronic expansion valves connected to the indoor heat exchangers are opened fully, the two way valves connected to the cooling mode return branch pipes are closed, and the two way valves connected to the vapor branch pipes and the liquid branch pipes are opened.

15. The multi-type air conditioner as claimed in claim 14, wherein the vapor refrigerant separated at the gas-liquid separator passes through the vapor pipe and the vapor branch pipes in succession, and is introduced into the indoor heat exchangers to heat the rooms, and the high pressure refrigerant condensed at the indoor heat exchangers to heat the rooms is discharged to the liquid pipe due to a pressure difference with the low pressure refrigerant which passes through the cooling mode electronic expansion valve, and flows in the liquid pipe.

16. The multi-type air conditioner as claimed in claim 9, wherein, in a condition where all the indoor units are configured to heat the rooms, or where a major number of the indoor units are configured to heat the rooms and rest of the indoor units are configured to cool the rooms, the first four way valve is switched to a state where the discharge side of the compressor and the second four way valve are connected, and the suction side of the compressor and the outdoor heat exchanger are connected, and the second four way valve is switched to a state where the second connection pipe and the outdoor heat exchanger are connected, and the first connection pipe and the first four way valve are connected.

17. The multi-type air conditioner as claimed in claim 16, wherein, in a condition where all the indoor units are to heat the rooms, the heating mode electronic expansion valve is controlled, and the cooling mode electronic expansion valve is closed fully, and all the electronic expansion valves provided to the indoor units are opened, all the two way valves connected to the vapor branch pipes and the liquid branch pipes are opened, and all the two way valves connected to the cooling mode return branch pipes are closed.

18. The multi-type air conditioner as claimed in claim 16, wherein, in a condition where a major number of the indoor units are configured to heat the rooms, and rest of the indoor units are configured to cool the rooms, the heating mode electronic valve is controlled, and the cooling mode electronic expansion valve is closed fully, and with regard to the indoor units which are configured to heat the rooms, the electronic expansion valves connected to the indoor heat exchangers are opened fully, the two way valves connected to the vapor branch pipes and the liquid branch pipes are closed, and the two way valves connected to the cooling mode return branch pipes are opened, and with regard the indoor units which are configured to cool the rooms, the electronic expansion valves connected to the indoor heat exchangers are controlled, the two way valves connected to the vapor branch pipes are closed, and the two way valves connected to the liquid branch pipes and the cooling mode return branch pipes are opened.

19. The multi-type air conditioner as claimed in claim 18, wherein the refrigerant passed through the indoor units which are configured to heat the rooms passes through the liquid branch pipes and the liquid pipe in succession, a portion of the refrigerant then flows to the heating mode return branch pipes, and rest of the refrigerant is introduced into liquid branch pipes connected to the indoor units which are configured to cool the rooms.

20. A method for operating a multi-type air conditioner, comprising:

switching a first four way valve such that refrigerant discharged from the compressor is introduced into an outdoor heat exchanger through a first connection pipe; and switching a second four way valve such that refrigerant of one of a liquid state and a liquid-gas state condensed at the outdoor heat exchanger is introduced into a gas-liquid separator through the first connection pipe, in a condition where all the indoor units are configured to cool the rooms, or where a major number of the indoor units are configured to cool the rooms and rest of the indoor units are configured to heat the rooms, and switching the first four way valve such that refrigerant discharged from the compressor is introduced into the second connection pipe; and switching a second four way valve such that refrigerant is introduced from the second connection pipe into a gas-liquid separator through the first connection pipe, in a condition where all the indoor units are to heat the rooms, or where a major number of the indoor units are configured to heat the rooms and rest of the indoor units are configured to cool the rooms.

* * * * *

UNITED STATES PATENT AND TRADEMARK OFFICE

CERTIFICATE OF CORRECTION

PATENT NO. : 6,883,345 B2
DATED : April 26, 2005
INVENTOR(S) : C. S. Lee

It is certified that error appears in the above-identified patent and that said Letters Patent is hereby corrected as shown below:

Title page,
Item [73], Assignee, "Electronic" should be -- Electronics --.

Column 8,
Line 30, "ovens" should be -- oven, --.
Line 49, before "magnetron" insert -- a --.

Column 9,
Line 19, before "raise" insert -- to --.

Column 10,
Line 37, after "oven" insert -- of --.

Signed and Sealed this

Sixth Day of December, 2005

JON W. DUDAS
*Director of the United States Patent and Trademark Office*

UNITED STATES PATENT AND TRADEMARK OFFICE

CERTIFICATE OF CORRECTION

PATENT NO. : 6,883,345 B2
DATED : April 26, 2005
INVENTOR(S) : C. S. Lee

It is certified that error appears in the above-identified patent and that said Letters Patent is hereby corrected as shown below:

Column 13,
Line 43, “exchange” should be -- exchanger --.

Column 18,
Line 8, after “are” insert -- configured --.

Signed and Sealed this

Thirteenth Day of December, 2005

JON W. DUDAS
*Director of the United States Patent and Trademark Office*